United States Patent [19]

Mitchell et al.

[11] 3,974,650

[45] Aug. 17, 1976

[54] EXHAUST REACTOR MANIFOLD

[75] Inventors: Harry R. Mitchell, Bloomfield Hills; Hal H. Rice; James R. Abel, both of Birmingham, all of Mich.

[73] Assignee: General Motors Corporation, Detroit, Mich.

[22] Filed: Sept. 15, 1975

[21] Appl. No.: 613,474

[52] U.S. Cl. ..... 60/282; 60/322

[51] Int. Cl.[2] ..... F01N 3/10

[58] Field of Search ..... 60/282, 302, 323, 322; 23/288 FC

[56] References Cited

UNITED STATES PATENTS 3,798,903 3/1974 Mitchell ..... 60/282

3,807,173 4/1974 Zmuda ..... 60/282

*Primary Examiner*—Douglas Hart

*Attorney, Agent, or Firm*—Robert J. Outland

[57] ABSTRACT

An exhaust reactor manifold having a reaction chamber formed by a hardened insulative ceramic liner which is supported within a protective housing. The liner walls are protected and insulated by compessible fibrous insulation. Springs and wedges in the housing act through the insulation blanket to load the liner walls in compression. Inlet and exhaust ports are provided through angled sealing surfaces of the liner which are urged by the compressive loading of the liner into engagement with mating surfaces of a ported mounting portion of the housing.

5 Claims, 7 Drawing Figures

EXHAUST REACTOR MANIFOLD

This invention relates to ceramic lined exhaust reactors for use with internal combustion engines and more particularly to exhaust reactor manifold arrangements utilizing ceramic liners retained within a protective housing with the walls under controlled compressive loading.

It is known in the art relating to exhaust reactors that certain hardened ceramics have insulating and wear resisting properties at high temperatures that make them desirable for use in exhaust gas reactors for internal combustion engines. However, ceramic materials are relatively brittle compared to metals and, therefore, may be broken in handling and use by the application of excessive stresses such as might be caused by differential expansion rates with metal components with which the ceramics are associated. Also, the mounting stresses and shock loads of normal engine and vehicle operation may cause failure if they create tensile stresses on any portion of the ceramic body, since ceramic members are considerably stronger in compression than in tension.

Our U.S. Pat. No. 3,798,903 granted Mar. 26, 1974 to the assignee of the present invention discloses an exhaust reactor manifold construction that takes account of the above facts and provides a compressively loaded ceramic reactor manifold in which the ceramic body is directly mounted on an associated engine. The construction also provides a protective metal cover and fibrous insulation blanket for insulating and protecting the ceramic body against accidental damage.

The present invention provides a different form of ceramic liner reactor manifold construction in which a metal housing performs the mounting function, as well as enclosing, protecting and insulating the ceramic liner, thus relieving the liner of shocks and loading resulting from the weight of the housing components themselves.

In manifolds according to the invention, the walls of the ceramic liner are positioned and shaped to permit compressive loading for maximum strength and positive engagement of preferably angled port containing sealing surfaces with mating ported surfaces of the housing. Resilient spring and wedge means may be utilized within the housing, acting through a fibrous insulating blanket to provide the desired compressive loading of the ceramic liner walls.

These and other features of the invention will be more fully understood from the following description of certain preferred embodiments taken together with the accompanying drawings.

In the drawings:

FIG. 1 is a side view of an internal combustion engine having mounted thereon a reactor manifold according to the invention;

FIGS. 2*a* and 2*b* are longitudinal cross-sectional views of alternative embodiments of ceramic liners for use in the manifold reactor of FIG. 1 and showing differing baffling arrangements of the liner interior;

Figure 1:
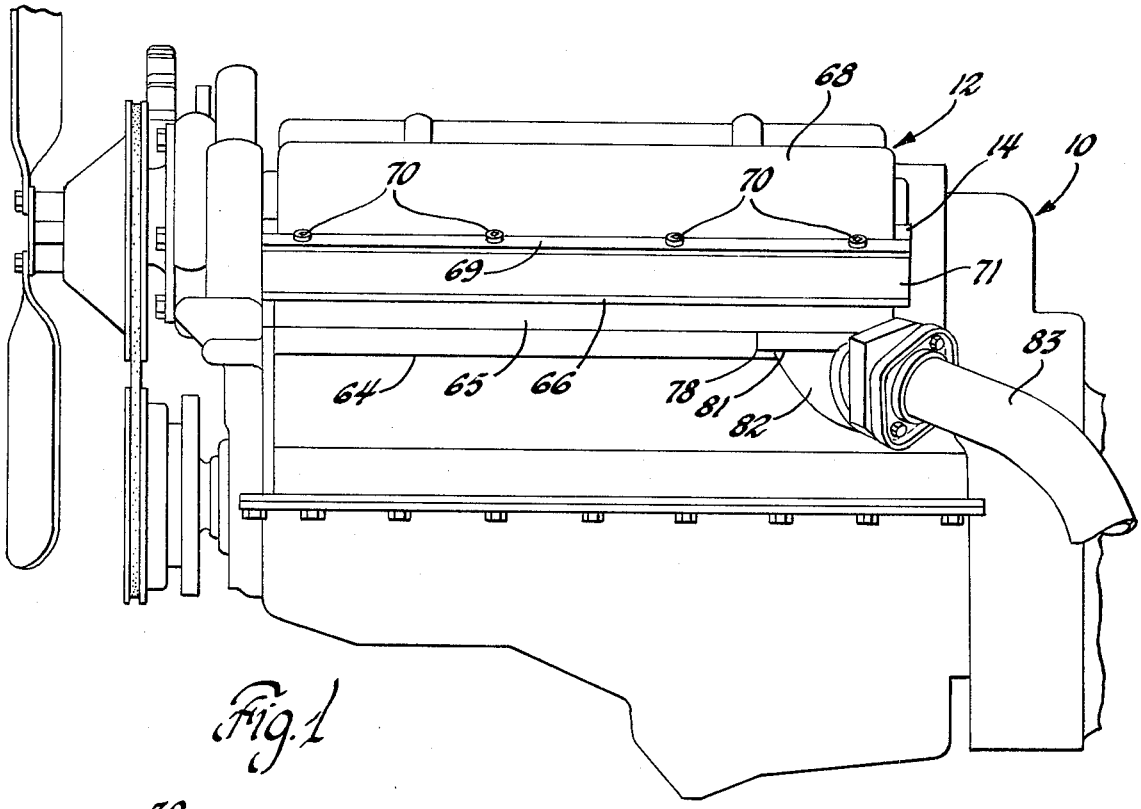
Figure 3:
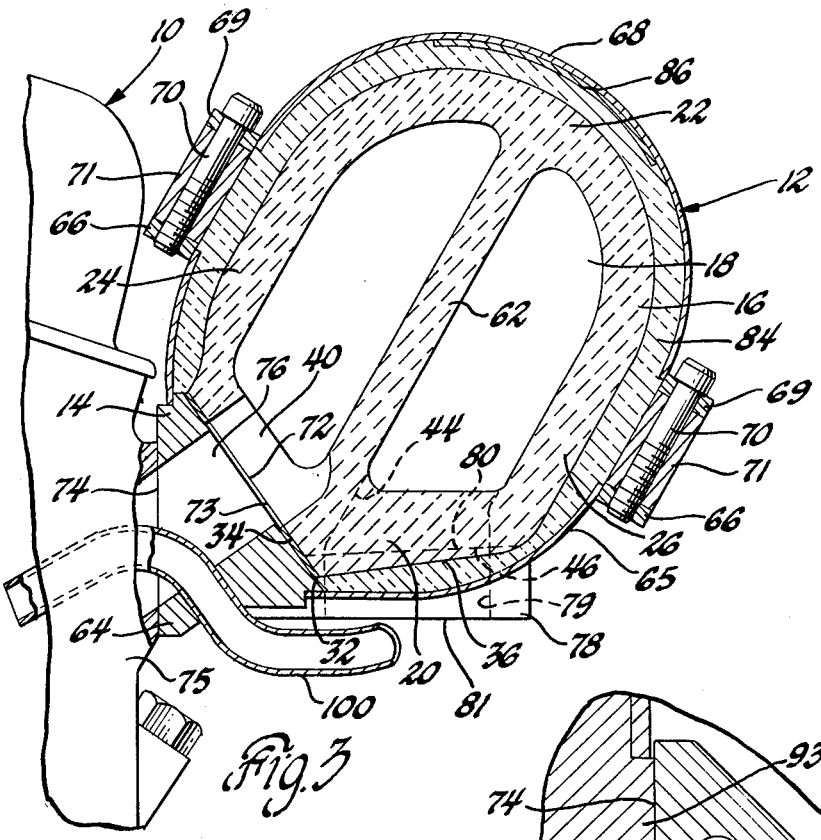
FIG. 3 is a transverse cross-sectional view of the engine and manifold assembly of FIG. 1 showing internal details of the manifold construction.

Referring now to the specific details of the drawings, numeral 10 generally indicates an internal combustion engine having mounted thereon an exhaust reactor manifold 12 formed according to the invention. As best shown in FIGS. 1 and 3, manifold 12 includes a housing 14 which encloses and protects a ceramic liner 16 that defines internally an exhaust gas reaction chamber 18.

The ceramic liner 16 is formed of any suitable hardened insulative ceramic material and by any appropriate method of manufacture. Examples of both materials and manufacturing methods which may be used in the construction of such liners are given in our aforementioned U.S. Pat. No. 3,798,903. However, it should be understood that other suitable materials and construction methods than those disclosed may be utilized to make liners in accordance with the present invention.

The liner 16 includes a V shaped longitudinally extending wall 20, an oppositely disposed dome shaped longitudinal wall 22, and opposed longitudinally extending side walls 24 and 26 interconnecting the "V" and dome shaped walls, thus defining an irregular tubular casing. The ends of the reaction chamber 18 defined by these walls are closed by suitable end walls 28 and 30.

The V shaped wall 20 has an apex 32 bordering a pair of angled outer surfaces including a first flat sealing surface 34 and a second flat outer surface 36. A plurality of exhaust gas inlet ports 38, 40, 42 extend through the V shaped wall on one side of the apex, opening through the sealing surface 34 and connecting with the reaction chamber 18. A gas outlet port 44 extends through the V shaped wall on the other side of apex 32, connecting the reaction chamber 18 with the exterior of the liner. Port 44 opens to a second flat sealing surface 46 which is recessed from the outer surface 36. A second recessed portion of the V shaped wall is also provided, having a recessed surface 50 spaced from, but coplanar with, the flat sealing surface 46 containing the exhaust port 44. The edges of the recessed surfaces 46, 50 are bounded by straight sides 52, 54 for purposes to be subsequently described.

Figure 2A:
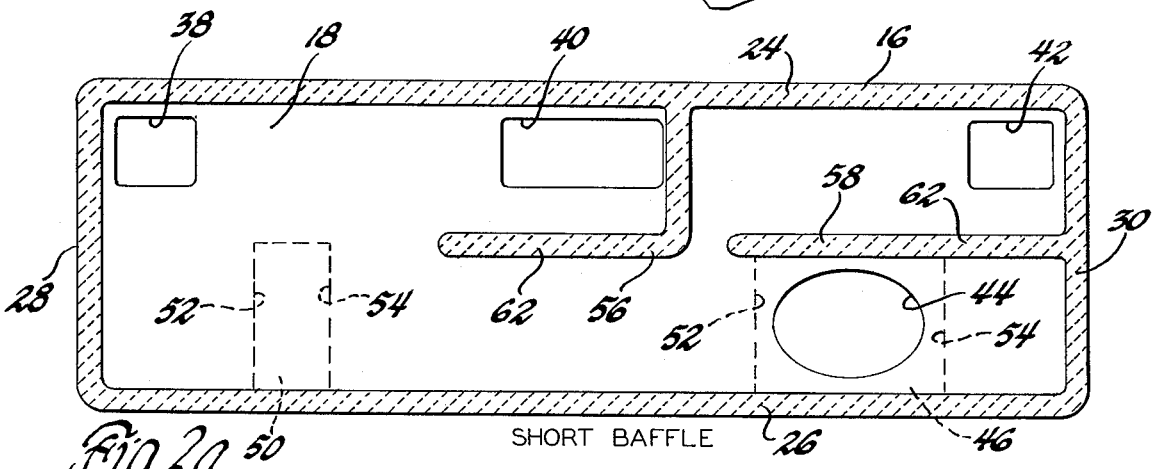
Figure 2B:
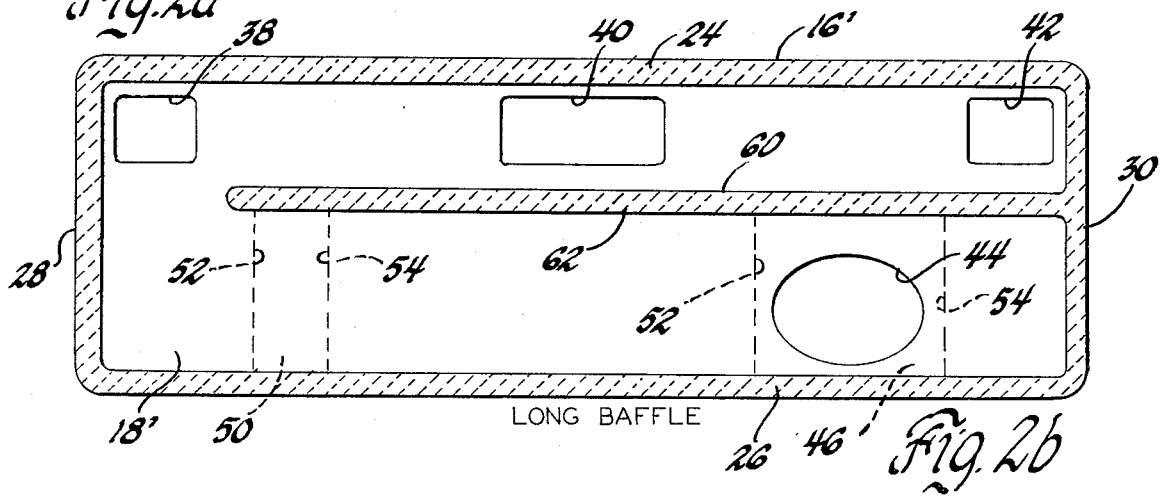

Within the reaction chamber 18, the liner 16 is provided with one or more baffles for directing exhaust gases in an extended path or paths from the inlet ports 38, 40, 42 to the exhaust port 44. FIG. 2*a* illustrates the use of two baffles 56, 58, while FIG. 2*b* shows a single longitudinally extending baffle 60. As illustrated, all the baffles include, or are formed exclusively of, longitudinally extending walls 62 which traverse part of the length of the reaction chamber and are disposed generally parallel to the side walls 24, 26. The longitudinal baffle walls 62 structurally interconnect central portions of the V shaped and dome shaped walls 20, 22 so as to be capable of transmitting compressive loads between them.

The reactor manifold housing 14 is constructed of several parts, including a cast mounting portion 64 that supports a sheet metal base section 65 having flanges 66. A sheet metal cover portion 68 with peripheral flanges 69 is secured to the lower portion by bolts 70. Spacer members 71 may be used between the flanges 70, if desired, or the base and cover portions may be designed so that the flanges engage one another without the use of spacers.

The mounting portion 64 includes an internal sealing surface 72 engagable through a sealing gasket 73 with the first sealing surface 34 of the liner and a mounting surface 74 engagable with a ported exhaust manifold mounting boss 75 of the engine 10. Inlet ports 76 are provided in the mounting portion which connect the ports 38, 40, 42 of the liner with the associated engine exhaust ports. The mounting portion 64 also includes an outlet section 78, containing an exhaust port 79, which extends through an internal sealing surface 80 engagable with the recessed second sealing surface 46 of the liner. An outer mounting surface 81 is also provided, to which an exhaust fitting 82 may be connected for attachment of an exhaust pipe 83.

The ceramic liner 16 is protectively supported within the housing 14 by a layer or blanket of compressible, high temperature insulating material 84, which may be, for example, a fibrous alumina-silica material available commercially from the Carborundum Co. under the trade name Fiberfrax, or a combination of such material and plain fiberglass. The insulating material 84 covers all surfaces of the liner, except the sealing surfaces 34 and 46 and the recessed surface 50, forming a protective insulating shield which permits relative expansion or movement of the housing and liner components without damage to the liner.

The dome shaped upper wall 22 of the liner is loaded compressively by one or more flat steel springs 86, which are placed inside the sheet metal cover 68 and act against the insulating blanket 84 to urge the liner downwardly. This biases the sealing surfaces 34, 46 into engagement with the mating surfaces of the housing mounting portion 64. Because of the shaping of the walls and baffles of the liner, the force of the spring loads provides a compressive preload on these walls which protects the integrity of the liner by limiting the possibility that shock loads applied to the manifold will cause any portion to be loaded in tension. In this way, the possibility that the liner may be damaged in operation is substantially reduced.

Figure 4:
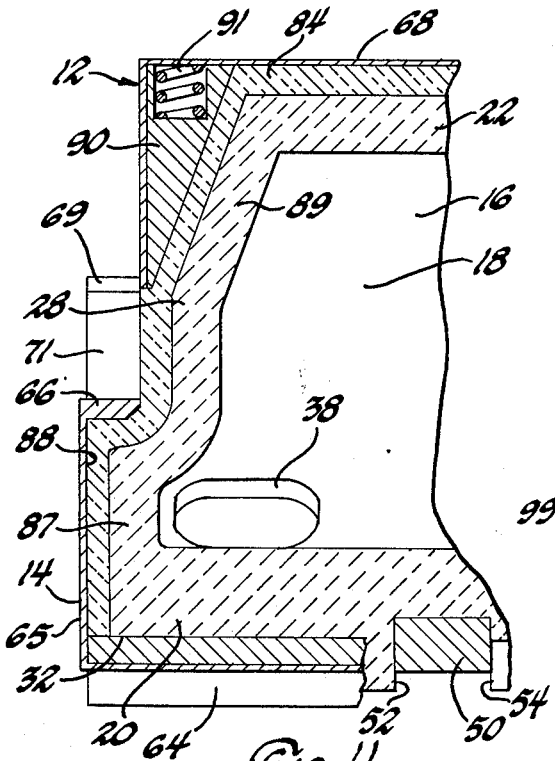
FIG. 4 is a longitudinal cross-sectional view showing an end portion of the manifold of FIGS. 1 and 3.

As shown in FIG. 4, the end wall 28 of the liner 16 includes an outwardly extending lug portion 87 which is received in an internally recessed portion 88 of the housing to aid in retaining the liner in position. Additionally, the upper ends of the liner walls are slanted, as at 89, and co-act through the blanket of insulating material 84 with wedges 90, urged downwardly by springs 91. These apply additional compressive loading to the liner walls. The wedges 90 also aid in preventing longitudinal movement of the liner within the housing. Such movement is further deterred by the interlocking fitting of the housing outlet section 78 with the flat sides adjacent the recessed sealing surface 46 where the exhaust port is located. In addition, another locking portion of the housing, not shown, engages recessed surface 50 and its sides 52, 54. Both these elements positively prevent substantial longitudinal movement of the liner within the housing.

Figure 5:
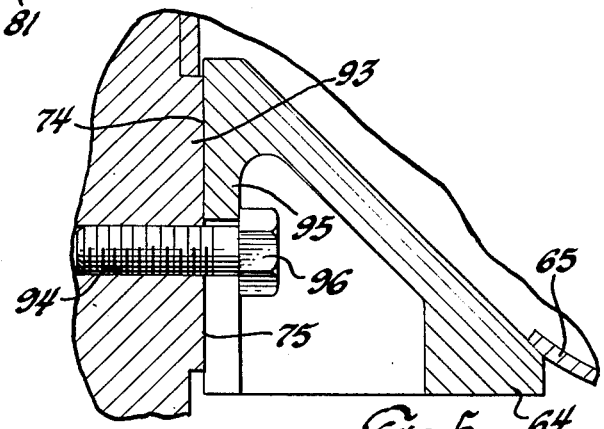
FIGS. 5 and 6 illustrate alternative mounting arrangements for engine and manifold assemblies.
Figure 6:
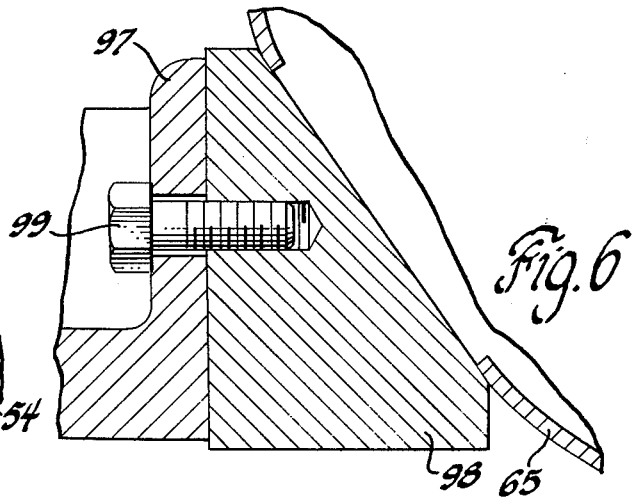

Alternative arrangements for mounting a manifold reactor on the engine are shown in FIGS. 5 and 6. The arrangement of FIG. 5 is used with standard cylinder head constructions that provide only a flat mounting boss 75 and threaded openings 94. With this arrangement, the mounting portion 64 is recessed to provide a slotted mounting flange 95, which is secured to the boss 93 by bolts 96.

In the alternative construction of FIG. 6, the cylinder head is provided with an upwardly extending flanged boss 97 to which a solid manifold mounting portion 98 may be secured by bolts 99 extending from the cylinder head flange. In either construction, provision may be made for the supply of secondary air to the engine exhaust ports by the provision of air inlet tubes 100 (FIG. 3) retained in the mounting portion 64 or 98 and extending into the engine inlet ports in known fashion.

While the invention has been described by reference to certain preferred embodiments of manifold reactors which best illustrate its features and advantages, it should be understood that numerous changes could be made without departing from the scope of the inventive concepts disclosed. Accordingly, it is intended that the invention not be limited, except by the language of the following claims.

What is claimed is:

1. An exhaust reactor manifold for an internal combustion engine, said manifold comprising a liner formed of hardened insulative ceramic and having end walls connected by longitudinal walls to define internally an elongated reaction chamber, said longitudinal walls including a sealing wall having a flat outer surface, a loading wall of dome shaped cross-section extending generally opposite said sealing wall, and opposed side walls interconnecting said loading and sealing walls, said sealing wall having a plurality of gas inlet ports through said flat outer surface and connecting with said reaction chamber, a layer of compressible heat resistant insulation covering said end and longitudinal walls but leaving exposed the flat outer surface of said sealing wall, a supporting and retaining housing enclosing said liner and insulation, said housing including separable base and cover elements secured together and shaped to compressively retain the insulation layer between the walls of said housing and liner, said base element including a mounting portion having a flat interior surface engaged by the flat outer surface of said liner sealing wall, said mounting portion containing inlet ports connecting with the liner inlet ports, and resilient means between said housing and said insulation layer adjacent said loading wall and loading the curved outer surface of said wall to urge said liner into positive sealing engagement of said sealing wall with the flat interior surface of said housing mounting portion.

2. An exhaust reactor manifold for an internal combustion engine, said manifold comprising a liner formed of hardened insulative ceramic and having end walls interconnected by longitudinal walls to define internally an elongated reaction chamber, said longitudinal walls including a first wall of generally "V" shaped cross-section with an outwardly pointing apex, a second wall having a dome shaped cross-section and disposed generally opposite to said first wall and opposed third and fourth side walls interconnecting said first and second walls, said first wall having a first flat sealing surface to one side of said apex with a plurality of gas inlet ports extending through said surface and connecting internally with said reaction chamber, a layer of compressible heat resistant insulation covering said end and longitudinal walls but leaving exposed the sealing surface of said first wall, a supporting and retaining housing closely enclosing said liner and its surrounding insulation, said housing including separable base and cover elements secured together and shaped to compressively retain the insulation layer betweens the walls of said housing and said liner, said base element including a thick walled mounting portion having a flat interior surface engaged by the flat sealing surface of said first longitudinal liner wall, said mounting portion containing inlet ports connecting with the inlet ports of said liner, and resilient means between said housing and said insulation layer adjacent said second wall and loading the curved outer surface thereof through said insulation layer to urge said liner into positive sealing engagement of the flat sealing surface of said first wall with the flat interior surface of said housing mounting portion, said arrangement providing compressive loading of said liner walls by said resilient means and distribution of such loading by said insulation layer to minimize shock damage to said liner during use under vibration and shock loading conditions.

3. The combination of claim 2 wherein said first liner wall further includes a second flat surface on the opposite side of said apex from said first flat sealing surface and an exhaust port through said wall opening to said second flat surface and connecting with said reaction chamber, and a longitudinal baffle within said reaction chamber, said baffle extending parallel to said third and fourth side walls and between said first and second walls so as to carry compressive loads directly between points on said first and second walls intermediate said third and fourth walls, said baffle dividing part of said reaction chamber into adjacent longitudinal sections with said exhaust port opening into one of said sections and at least one of said inlet ports opening into the other of said sections.

4. The combination of claim 3 wherein said first liner wall includes third surface areas adjacent the area of said second flat surface and on the same side of said apex, one of said second and third surface areas being recessed with respect to the other, and said housing having a mounting portion mating with the recessed one of said surface areas and engaging the sides of said recess to positively locate said liner longitudinally within said housing and prevent longitudinal shifting of the liner within the housing.

5. The combination of claim 2 and further including wedge means in said housing and acting on said insulation layer to load the end walls of the liner inwardly and laterally in a direction to aid in seating said first wall against said housing flat interior surface.

* * * * *